US007762929B1

(12) United States Patent
Celone

(10) Patent No.: US 7,762,929 B1
(45) Date of Patent: Jul. 27, 2010

(54) GOLF SWING EXERCISE DEVICE

(75) Inventor: Thomas J. Celone, Reno, NV (US)

(73) Assignee: TC Trust, LLC, Naples, FL (US)

( * ) Notice: Subject to any disclaimer, the term of this patent is extended or adjusted under 35 U.S.C. 154(b) by 1003 days.

(21) Appl. No.: 10/639,236

(22) Filed: Aug. 11, 2003

Related U.S. Application Data

(60) Provisional application No. 60/402,443, filed on Aug. 9, 2002.

(51) Int. Cl.
*A63B 21/00* (2006.01)

(52) U.S. Cl. ..... 482/49; 482/111; 482/109

(58) Field of Classification Search ..... 482/109, 482/111, 45, 49; 5/120, 121–130; 472/118; 297/277; 105/320; 35/138; 473/219, 409, 473/229; 434/247
See application file for complete search history.

(56) References Cited

U.S. PATENT DOCUMENTS

| | | | | | |
|---|---|---|---|---|---|
| 402,307 | A | * | 4/1889 | Collins | 5/128 |
| 501,944 | A | * | 7/1893 | Hines | 5/122 |
| 572,424 | A | * | 12/1896 | Hines | 5/120 |
| 4,576,378 | A | * | 3/1986 | Backus | 473/228 |
| 5,335,918 | A | * | 8/1994 | Rupnik et al. | 473/228 |

* cited by examiner

*Primary Examiner*—Jerome Donnelly
(74) *Attorney, Agent, or Firm*—Ronald E. Smith; Smith & Hopen, P.A.

(57) ABSTRACT

The disclosed device is directed toward a golf swing exercise device comprising a body having a first end and a second end opposite the first end. The body includes a resistance section between the first and second ends. A first coupling element is coupled to the body proximate the first end. A second coupling element is coupled to the body proximate the second end. The first coupling element and the second coupling element are configured to rotatably couple the body to a golf club shaft.

3 Claims, 8 Drawing Sheets

GOLF SWING EXERCISE DEVICE

PRIORITY CLAIM

This application claims priority to Provisional Patent Application No. 60/402,443 filed with the United States Patent and Trademark Office on Aug. 9, 2002.

BACKGROUND

The present disclosure relates to a golf exercise apparatus, and particularly to golf exercise apparatus that provides resistance to a golfer's swing.

Golf is an activity enjoyed by many people of all ages possessing varying degrees of athletic ability, strength and endurance. Although it is possible to perform a golf swing without having excessive strength, greater bodily strength and endurance allows a golfer to hit a golf ball farther and with greater accuracy and consistency for a complete round of golf.

Golfers purchase a large amount of golf paraphernalia to improve their golf swings. Existing golf paraphernalia include devices to improve the grip of the golfer by preventing the wrist of the golfer from moving to a position other than what is pre-set by the device. Special gloves also exist to direct the golfer to place his or her hands on the shaft of the golf club correctly.

External devices are currently being marketed to help train the muscles of the golfer to move along a pre-determined path that is thought to be along an optimal golf swing path. These devices restrict the swing path of the golfer to a plane within which it is thought necessary to maintain the golf club throughout the golf swing. However, no resistance is supplied in the direction of rotation of the shoulders and upper torso, or the hips, of the golfer during performance of an exercise using an external device of this type. Further, these devices fail to train the golfer to progressively accelerate the golf club during the downswing.

Extendable golf club-like devices are currently being used which extend in response to centrifugal acceleration. During a practice golf swing of a golfer, the extendable device remains coiled during the first part of the golf swing if the golf swing is performed correctly, thus teaching a golfer to begin the downswing slowly. The device then becomes fully extended at the point of most rapid acceleration of the golf club, which should occur when the clubface is in close proximity to a golf ball whose propulsion into the air is targeted as the object of the golf swing. The golfer is thus trained to accelerate the golf club at the proper time and but not along the correct swing path by the extension response of the device. The devices are configured to resist the swing through a rigid air resistance means fixed to a non-golf club handle. However, the rigid nature of the air resistance means creates aerodynamic forces that alter the swing-path of the club. The result of using the rigid air resistance means, creates poor golf swing mechanics that are inconsistent and rarely repeatable.

In summary, existing golf devices either attach to the hands, wrists or other parts of the body of a golfer, or are held by the golfer, only to either train parts of the body of the golfer to maintain a correct orientation, restrain the golf swing of the golfer to a correct swing path, or train the golfer to accelerate at the proper point of the downswing with deleterious influence on the swing-path. None of these devices can be used as the golfer practices hitting golf balls on the practice range.

What is needed in the art is a golf swing practice device that provides resistance during a downswing without altering the swing path as well as being capable of being used to hit balls in a non-simulated fashion.

SUMMARY

The disclosed device is directed toward a golf swing exercise device comprising a body having a first end and a second end opposite the first end. The body includes a resistance section between the first and second ends. A first coupling element is coupled to the body proximate the first end. A second coupling element is coupled to the body proximate the second end. The first coupling element and the second coupling element are configured to rotatably couple the body to a golf club shaft.

In another embodiment the disclosed device is directed toward a golf swing exercise device comprising a body having a first end and a second end opposite the first end. A resistance section is located between the first end and the second end. The body is flexible along the resistance section and rigid proximate the first end and the second end, wherein the resistance section is configured to resist air. A first coupling element is coupled to the first end through a first flexible member and is configured to rotatably couple to a golf shaft. A second coupling element is coupled to the second end through a second flexible member and is configured to rotatably couple to the golf shaft opposite the first coupling, wherein the golf swing exercise device is configured to provide air resistance to a golf swing in the absence of imparting forces that offset the golf swing.

A method of using a golf swing exercise device is disclosed. The method comprises attaching the golf swing exercise device to a golf club, wherein a first coupling element is attached to the golf club shaft proximate a hand grip of the golf club and a second coupling element is attached to the golf club shaft proximate a club head of the golf club. The golf swing exercise device includes a body having a first end and a second end opposite the first end, the body includes a resistance section between the first and second ends. A first coupling element is coupled to the body proximate the first end. A second coupling element is coupled to the body proximate the second end. The first coupling element and the second coupling element are configured to rotatably couple the body to the golf club shaft. The method includes performing a golf swing having a backswing portion and a front swing portion. The method includes exerting air resistance during the front swing through the resistance section. The method includes imparting negligible forces that offset a swing path during the front swing portion.

BRIEF DESCRIPTION OF THE DRAWINGS

Referring now to the figures, wherein like elements are numbered the same.

DETAILED DESCRIPTION

Persons of ordinary skill in the art will realize that the following description of the present disclosure is illustrative only and not in any way limiting. Other embodiments of the invention will readily suggest themselves to such skilled persons having the benefit of this disclosure.

The present disclosure describes a golf swing exercise device including a body formed from an air-resistant material. The body is substantially rectilinear and includes lanyards attached at opposing first and second ends of the body. The lanyards attach to a golf club shaft between the hand-grip and the club head via swivel mounting means. The body is coupled to the golf club in a rotary fashion such that the body is free to rotate about the club shaft on the swivel mounting means. The body imitates a wind chute when the club is swung in a golf swing. The golf swing exercise device provides resistance to the golf swing while freely adjusting to the air resistance and imparting negligible lateral forces that may offset or disturb the swing-path of the golfer.

Figure 1:
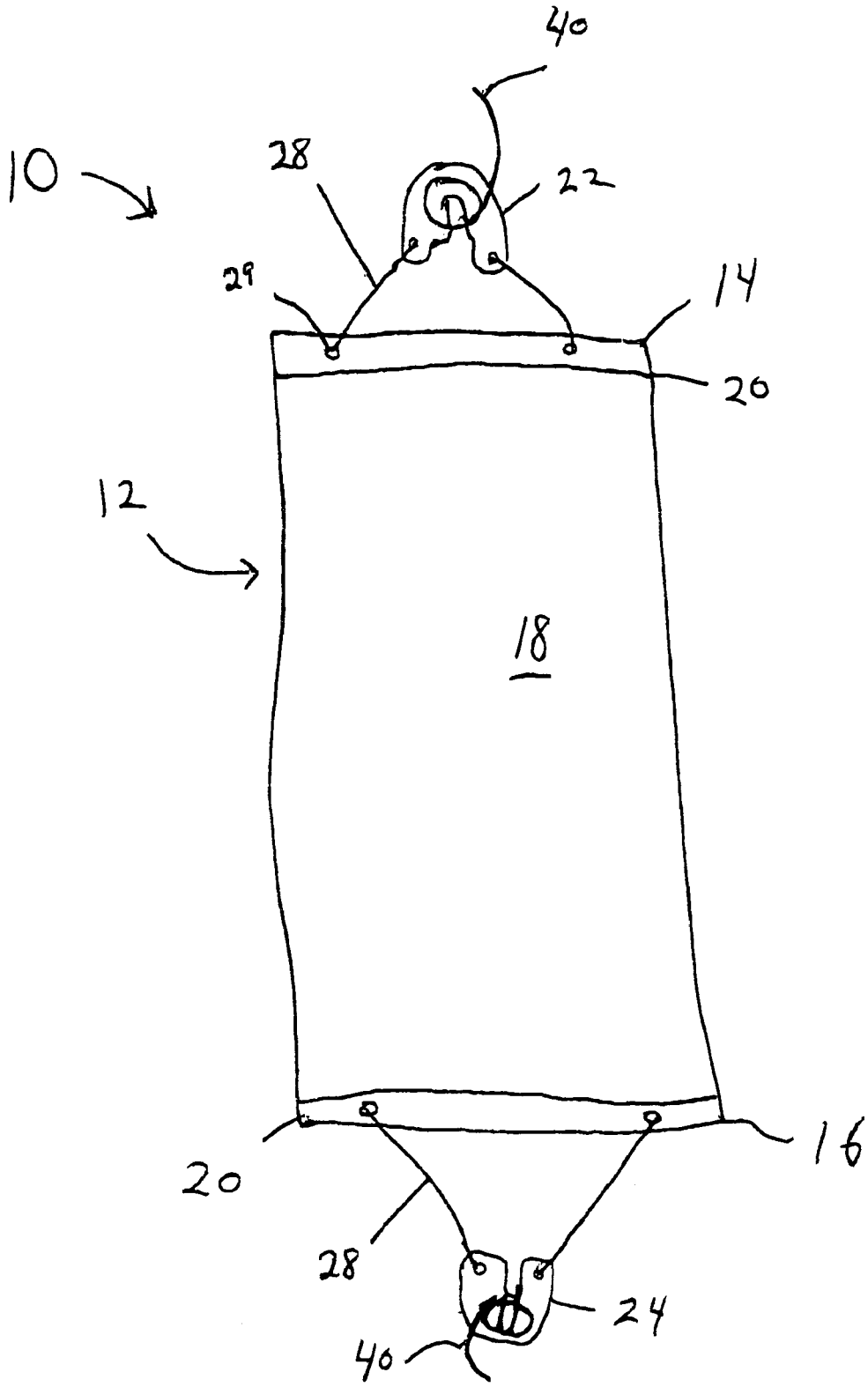
FIG. 1 is a front perspective view of an exemplary golf swing exercise device.
Figure 2:
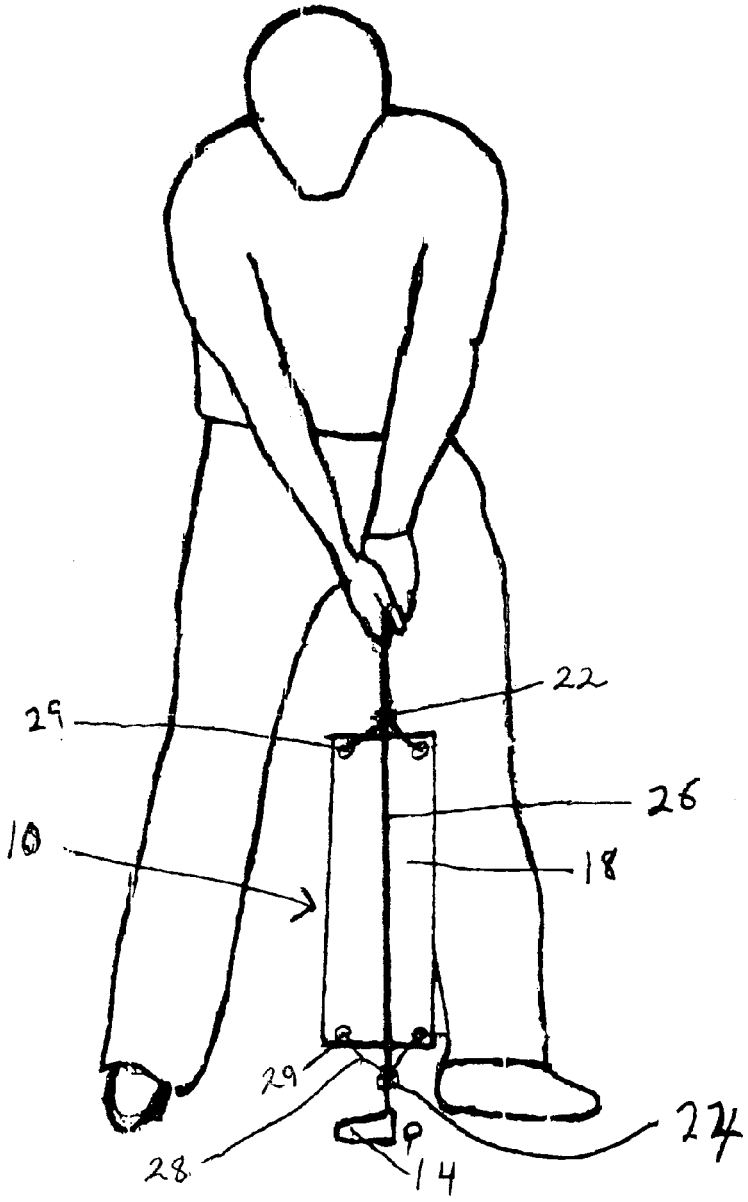
FIG. 2 is a front perspective view of an exemplary golf swing exercise device coupled to a golf club held by a golfer.
Figures 3, 4, 5:
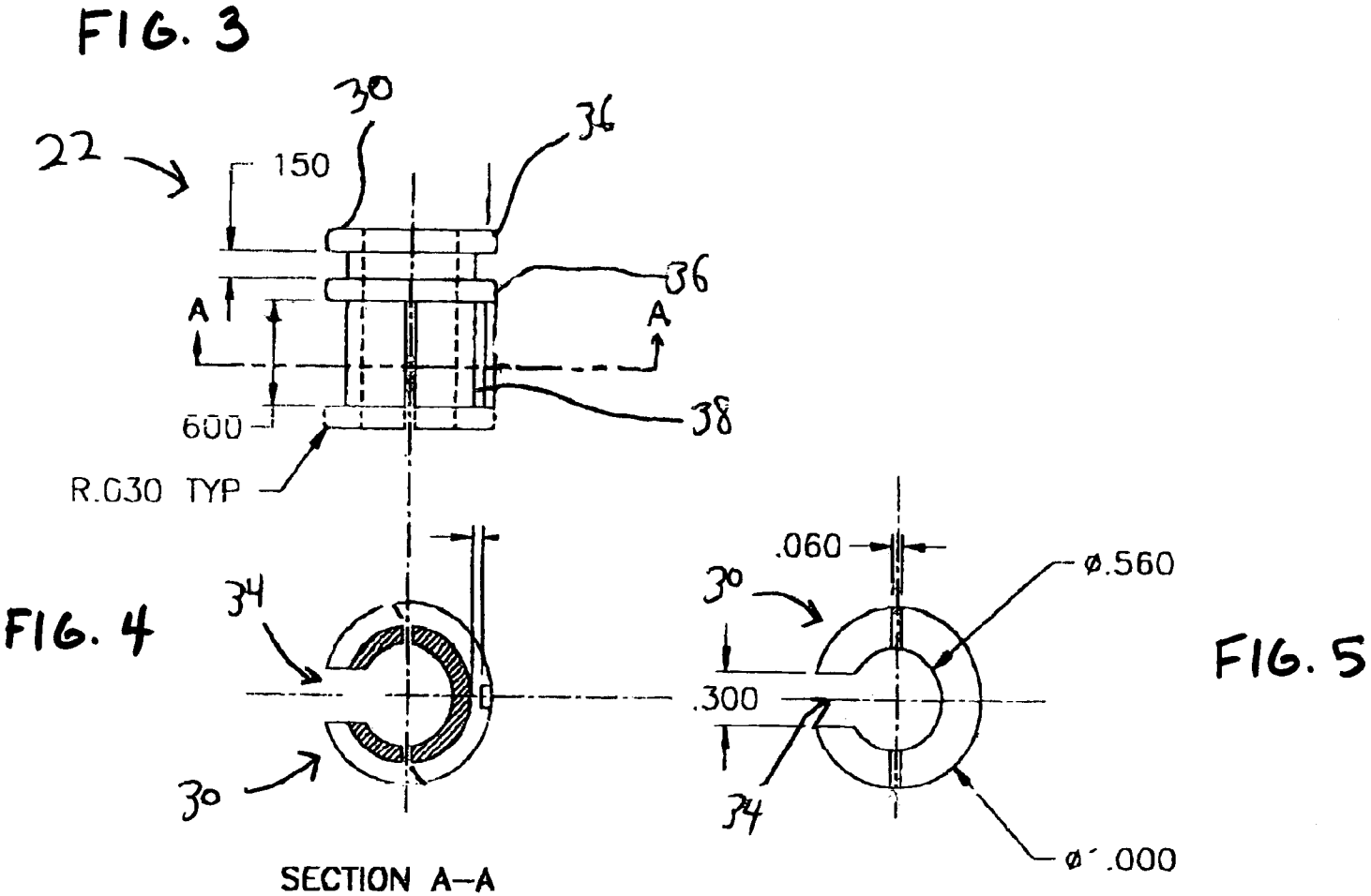
FIG. 3 is a side view of an exemplary bushing of a coupling element.
FIG. 4 is a top cross-sectional view across A-A of FIG. 2, of the exemplary bushing of the coupling element.
FIG. 5 is a bottom cross-sectional view across A-A of FIG. 2, of the exemplary bushing of the coupling element.
Figure 6:
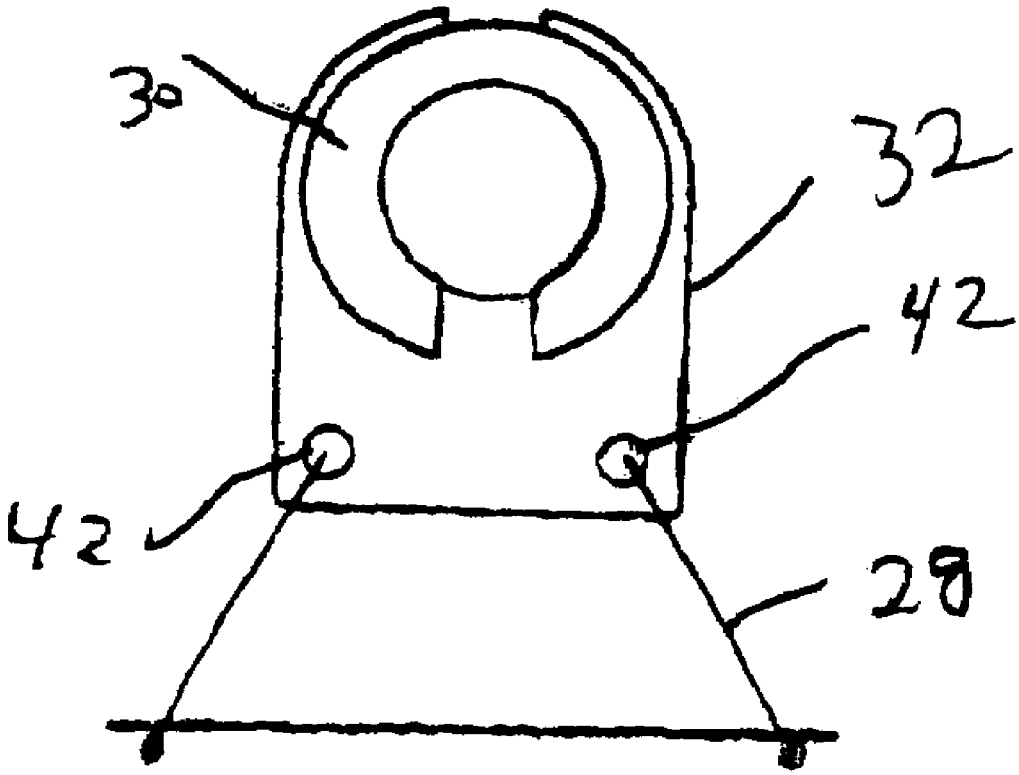
FIG. 6 is top view of the exemplary coupling element.
Figure 7:
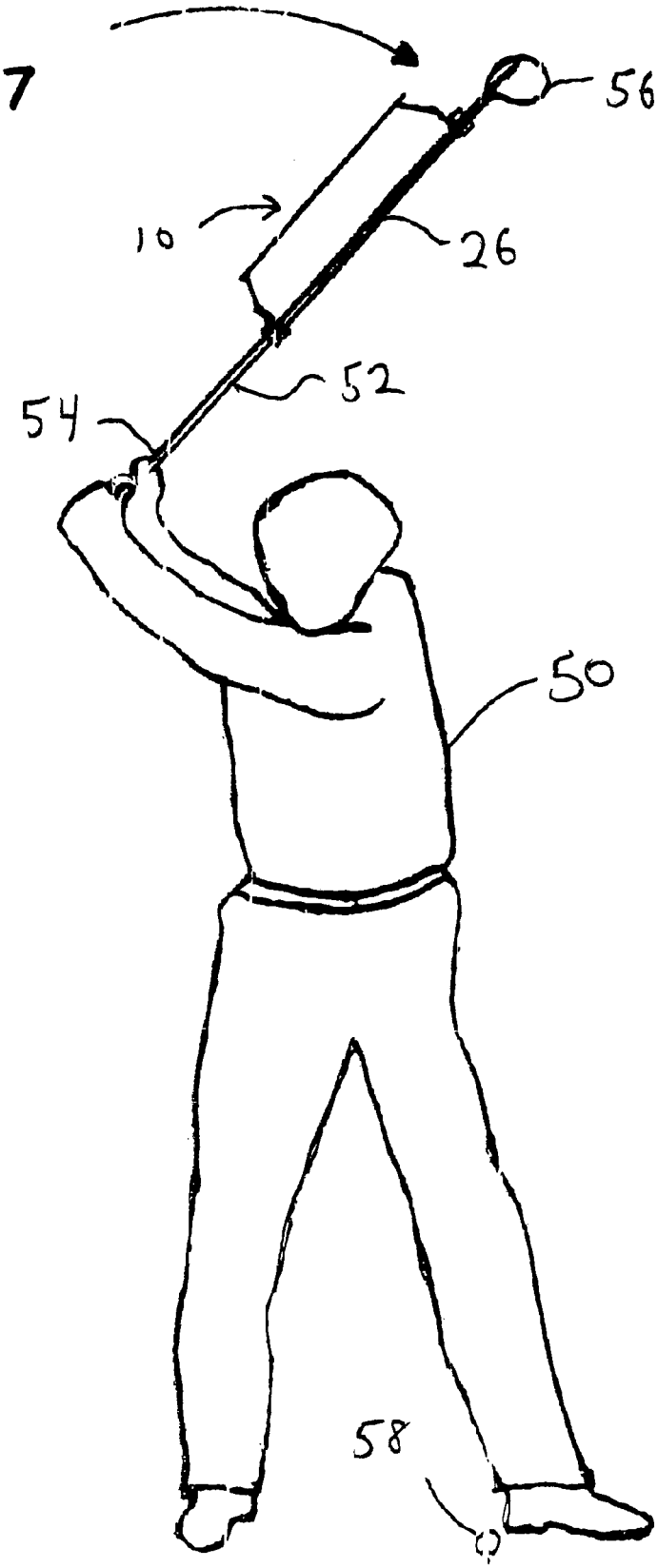
FIG. 7 is a perspective view of the golf swing exercise device coupled to a golf club held by a golfer in a backswing.

Referring to FIGS. 1 and 2 a top view of the golf swing exercise device is illustrated and the golf swing exercise device is shown attached to a golf club held by a golfer. The golf swing exercise device 10 includes a body 12 having a first end 14 and a second end 16 opposite the first end 14. The body 12 is configured as a light-weight chute having an air resistance section 18 and having rigid or reinforced stiffener elements 20 proximate the first end 14 and the second end 16. The stiffener elements 20 maintain the air resistance section 18 of the body 12 in an open orientation configured to create air resistance. The body 12 can be constructed of any light-weight, air resistant material. In a preferred embodiment, the body is a vinyl sheet.

A set of coupling elements, a first coupling element 22 and a second coupling element 24 are coupled to the body 12 proximate the first end and second end respectively. The coupling elements 22, 24 are configured to couple to a golf club shaft 26 and allow for rotary motion of the body 12 around the golf club shaft 26. The coupling elements 22, 24 allow for full rotation. In a preferred exemplary embodiment, a flexible element or simply a cord or other lanyard type element 28 attaches the coupling elements 22, 24 to the body 12. The flexible element 28 can include at least one cord or in an exemplary embodiment can include a pair of cords for each of the first end 14 and the second end 16. Eyelets or openings 29 can be formed in the first and second ends of the body 12 to receive the cord 28. The body 12 is illustrated as a substantially rectilinear shaped sheet, however, alternate shapes can be deployed to provide a maximum quantity of air resistance while minimizing the lateral forces that can offset a golf swing path of line of trajectory.

Referring to FIGS. 3 through 6 the exemplary coupling element is illustrated in greater detail. The coupling elements 22, 24 include a bushing member 30 disposed in an attachment member 32. The bushing member 30 has a slot 34 that is configured to dispose over the golf club shaft 26. The attachment member 32 can attach to the bushing member 30 in a rotary fashion to freely rotate about the bushing member 30. The bushing member 30 can be fixed about the shaft of the golf club, while the attachment member 32 freely swivels about the bushing member 30. In this configuration, the body 12 coupled to the coupling members 22, 24 is free to rotate with the attachment member 32 while being secured to the golf club shaft 26. The coupling members 22, 24 can be constructed from EPDM rubber or "buna-n," which is a copolymer of butadiene and acrylonitrile, a compound that is commonly used in o-rings. Other plastics having high strength can be used.

The bushing member 22, 24, includes regions of greater diameter or simply ridges 36. A receiver 38 is configured to receive a strap 40 for attaching the coupling members 22, 24 to the shaft 26. The receiver 38 and strap 40 can include a hook and loop fastener adjustably fixed about the coupling 22, 24 and the shaft 26. The strap 40 can serve to tighten the bushing member 30 about the shaft 26. Straps, buckles and the like can be used for the strap 40. The attachment member 32 is illustrated with two bores 42 for attaching the flexible element 28. It is contemplated that any number of bores 42 can be formed in the attachment member 32 to couple the flexible element 28. It is also contemplated that the attachment member 32 can be directly coupled to the body 12 in alternate embodiments.

Referring to FIGS. 7-10, the exemplary golf swing exercise device 10 is illustrated in use by a golfer 50. The golfer 50 holding a golf club 52 with shaft 26 and the golf swing exercise device 10 coupled to the shaft 26 near the golf hand grips 54 and the golf club head 56. The body 12 of the device is free to rotate about the shaft 26 as well as flex in response air resistance and gravitational effects on the body 12. In a golf swing, the golfer 50 addresses the ball 58 and grips the golf club with both hands. The golfer 50 begins the action of hitting the golf ball 58 with a back swing action. The back swing removes the club away from the ball backwards and raises the club up above the head while rotating the shoulders about the midsection of the torso. The golf swing exercise device 10 is not actively involved in the back swing. This is the case since the backswing is performed at a slower rate of speed and does not generate a great deal of air resistance. The body 12 freely rotates about the shaft 26 as a result of gravitational forces acting on the weight of the body 12. The free rotation of the body 12 does not influence the back swing.

Figure 8:
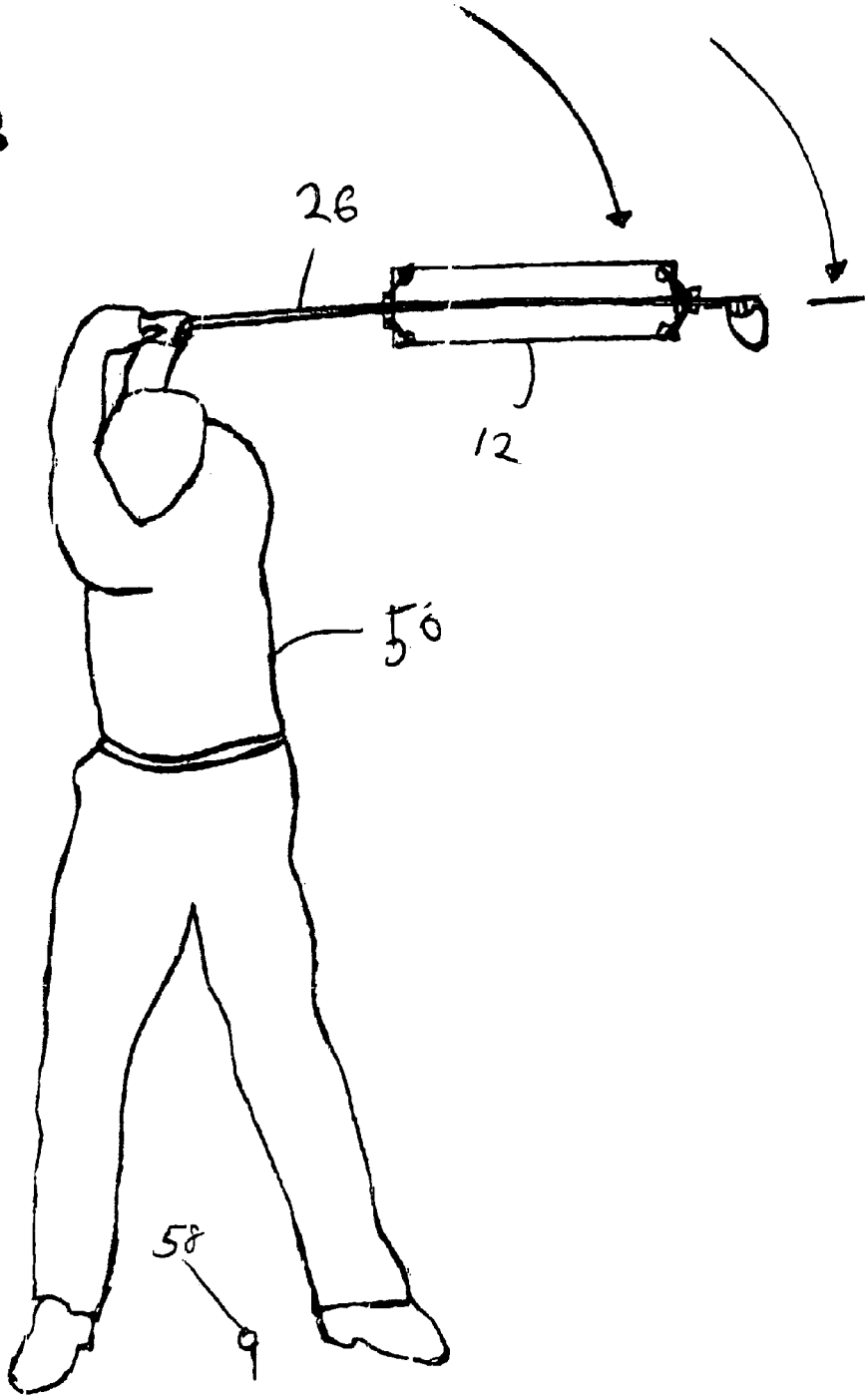
FIG. 8 is a perspective view of the golf swing exercise device coupled to a golf club held by a golfer in a backswing.
Figure 9:
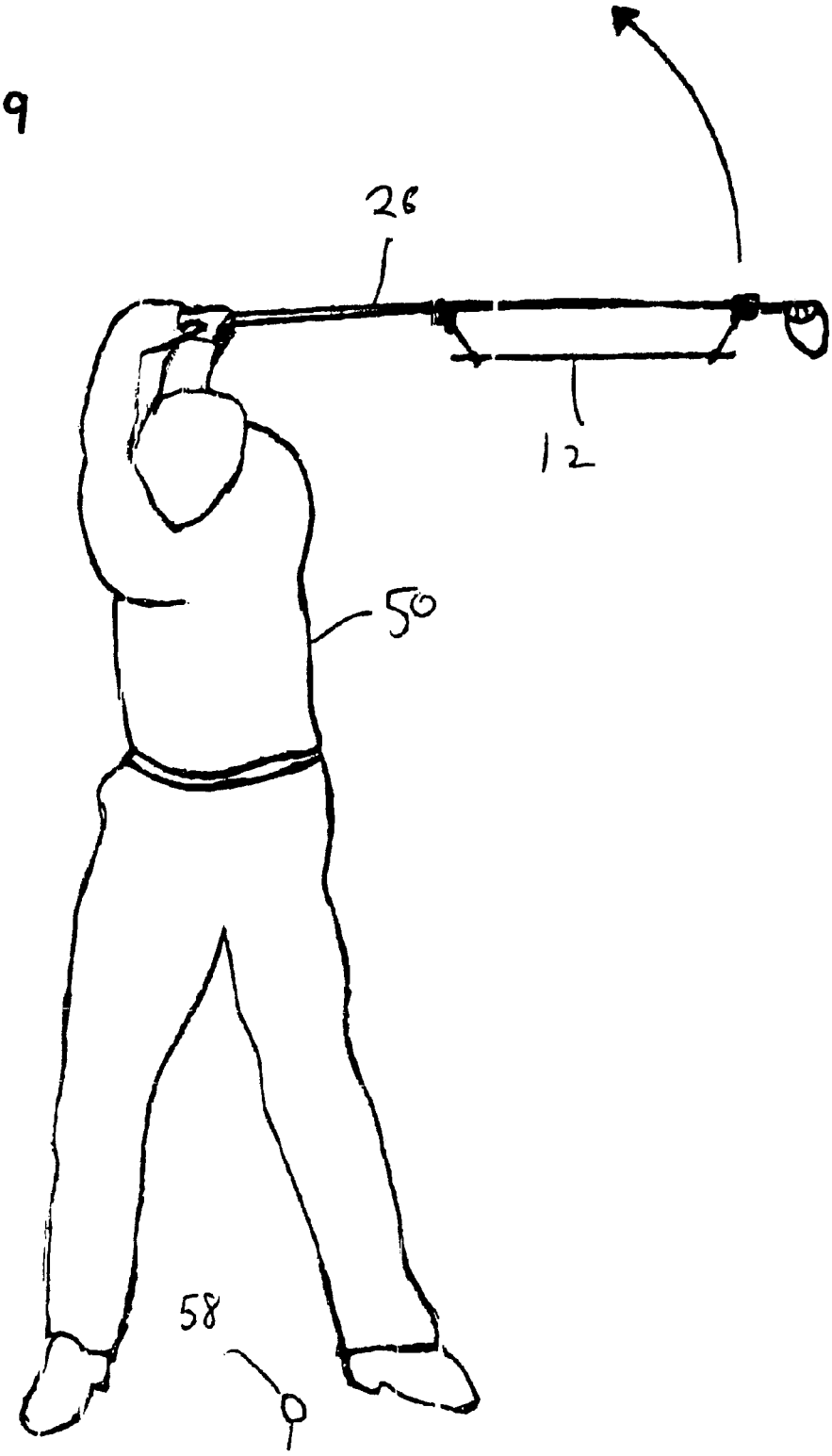
FIG. 9 is a perspective view of the golf swing exercise device coupled to a golf club held by a golfer in a front swing.
Figure 10:
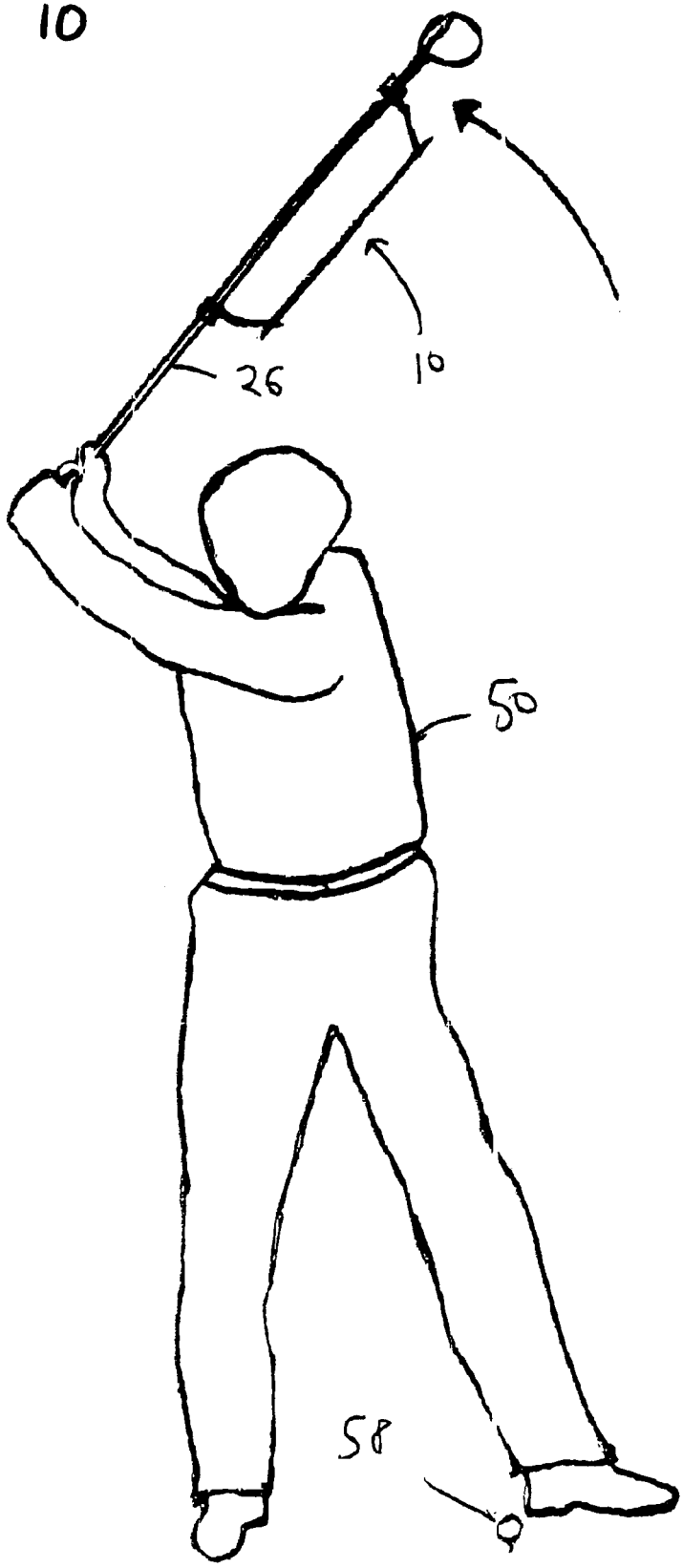
FIG. 10 is a perspective view of the golf swing exercise device coupled to a golf club held by a golfer in a front swing.

The golfer 50 ceases the back swing and commences the down swing or front swing (FIGS. 8 and 9). In the front swing a rapid acceleration of the club toward the golf ball 58 is performed. The golfer 50 rotates the hips and in turn rotates the torso and shoulders resulting in the arms and hands gripping the club to accelerate and rotate along a golf swing path directed at placing the club face on the golf ball 58 at a high rate of speed and in a particular orientation to launch and direct the ball toward a target. The golf swing path can be likened to an arc shaped path that follows the golfers rotation about the legs and hips. Deviation from the golf swing path influence the orientation of the club face on the ball at impact. The result of deviating the golf swing path is missing the intended target. The golf swing exercise device 10 provides a source of air resistance to the golf club and acts to slow the club swing speed. The golfer strengthens the muscles that perform the swing through the resistance of the golf swing exercise device 10. As the golfer builds strength to overcome the air resistance, the golfer increases the capability to swing the club at greater speed. The unique flexibility and manner in which the golf swing exercise device reacts while in a front swing allows for a negligible effect on the golf swing path while providing a resistance to the swing.

The golf swing exercise device 10 reacts to the movement of the golf club 26 through the air and swings behind the club shaft 26, trailing the club shaft 26 as the club shaft accelerates through the air. The air resistance portion 18 acts like a chute in the air and creates air resistance opposing the swing force of the golfer 50. However, the golf swing exercise device 10 being freely attached, rotates and follows the swing path instead of creating aerodynamic forces that can alter the swing path. Since the golf swing path is not altered by the reaction of the body 12 in the air during a front swing, the golfer can employ the golf swing exercise device 10 during actual golf practice, hitting golf balls 58 on the golf range.

As the golfer 50 builds muscle memory in response to the greater resistance to swing in the golf swing path, the golfer upon removal of the golf swing exercise device 10 can increase the swing speed and hit the golf ball a greater distance. The golf swing exercise device 10 adjusts while moving through the air and follows the club during the front swing while imparting negligible lateral forces that can alter the golf swing path. The golfer 10 is able to improve the swing speed, while avoiding the deleterious bad muscle memory from adverse reaction forces on the club swing path.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A golf swing exercise device, comprising:

a golf club having a golf club shaft;

an elongate body having a first end and a second end opposite said first end;

said elongate body including an air resistance member disposed between said first end and said second end of said elongate body;

said air resistance member of said elongate body being flexible;

said air resistance member having a first rigid member disposed at a first end of said air resistance member and a second rigid member disposed at a second end of said air resistance member, said first and second rigid members being disposed transversely to a longitudinal axis of said air resistance member;

a first coupling element detachably secured to said golf club shaft near a first end of said golf club shaft;

a second coupling element detachably secured to said golf club shaft near a second end of said golf club shaft;

a first flexible cord disposed in interconnecting relation between said first coupling element and a first end of said first rigid member;

a second flexible cord disposed in interconnecting relation between said first coupling element and a second end of said first rigid member;

a third flexible cord disposed in interconnecting relation between said second coupling element and said first end of said second rigid member;

a fourth flexible cord disposed in interconnecting relation between said second coupling element and said second end of said second rigid member;

a first swivel means collectively formed by said first coupling element and said first and second flexible cords;

a second swivel means collectively formed by said second coupling element and said third and fourth flexible cords;

said first and second swivel means enabling said air resistance member to rotate about said golf club shaft when said golf club is swung by a user.

2. The golf swing exercise device of claim 1 wherein said first and second coupling elements include a fastening member configured to fasten to said golf club shaft.

3. The golf swing exercise device of claim 2 wherein said fastening member includes a flexible band having a hook and loop fastener set for adjustable fastening about said golf club shaft.

* * * * *